US005991568A

United States Patent [19]

Ziegelmuller et al.

[11] Patent Number: 5,991,568

[45] Date of Patent: Nov. 23, 1999

[54] BLADE CLEANING APPARATUS WITH ASSOCIATED DUST SEAL AND METHOD OF CLEANING

[75] Inventors: Francisco L. Ziegelmuller, Penfield; Theodore H. Morse, Rochester, both of N.Y.

[73] Assignee: Eastman Kodak Company, Rochester, N.Y.

[21] Appl. No.: 09/219,046

[22] Filed: Dec. 23, 1998

[51] Int. Cl.[6] ..... G03G 21/00

[52] U.S. Cl. ..... 399/102; 399/349; 430/125

[58] Field of Search ..... 399/102, 98, 99, 399/343, 349, 350, 351; 15/1.51, 256.5; 430/125

[56] References Cited

U.S. PATENT DOCUMENTS

| | | | |
|---|---|---|---|
| 4,426,151 | 1/1984 | Aguro et al. | 399/349 |
| 4,527,887 | 7/1985 | Vineski | 399/102 |
| 4,561,766 | 12/1985 | Fox | 399/102 |
| 4,862,209 | 8/1989 | Sakamoto et al. | 399/102 |
| 5,721,085 | 2/1998 | Oshiba et al. | 430/125 |

FOREIGN PATENT DOCUMENTS

WO 98/04961 2/1998 WIPO .

OTHER PUBLICATIONS

US Patent Applic. 09/053,504, filed Apr. 4, 1998, in the names of Theodore Morse et al Entitled: Method and Apparatus for the Removal of Toner and Magnetic Carrier Particles from a Surface.

*Primary Examiner*—William Royer
*Assistant Examiner*—Sophia S. Chen
*Attorney, Agent, or Firm*—Norman Rushefsky

[57] ABSTRACT

A method and apparatus for cleaning toner and/or other contaminant particles from a moving surface to be cleaned in an electrostatographic apparatus includes a cleaning blade, such as a wiper blade or a scraper blade, that engages the surface to be cleaned at a first location to remove the particles from the surface. A dust seal blade is provided that extends toward the surface in a second direction generally opposite to the first direction, which corresponds to the direction of motion of the surface to be cleaned, and is of a length and supported so as to be able to contact the surface to be cleaned at a second location upstream of the first location. The cleaning blade, the dust seal blade and the surface to be cleaned form a cavity for containing contaminant particles to assist in operation of the cleaning blade apparatus.

15 Claims, 9 Drawing Sheets

BLADE CLEANING APPARATUS WITH ASSOCIATED DUST SEAL AND METHOD OF CLEANING

FIELD OF THE INVENTION

This invention relates to electrostatography and more particularly to cleaning devices for removing toner and other particles from various surfaces in electrostatographic printers and copiers.

BACKGROUND OF THE INVENTION

Blade cleaners have been used extensively in electrostatographic copiers and printers as a method of removing untransferred toner particles, carrier particles and other foreign matter such as paper dust, lint and fibers from the surface of an organic or inorganic photoconductor drum or a web.

Blade cleaners have also been applied with other type of cleaners such as magnetic brush and conductive brush cleaners as a method to remove contaminants from a detone roller. Detone rollers are used to remove contaminants from the brushes. In these applications, the cleaning blade does not contact the photosensitive surface. There are still other applications requiring a blade in contact with the surface to be cleaned in which such contact occurs downstream of brush cleaning methods.

Blade cleaners have also been applied to clean other surfaces which are not photosensitive such as an intermediate transfer roller or web, transfer rollers and transport webs in process color copiers or printers.

Cleaning blades come in either scraper or wiper configuration as illustrated in FIGS. 1 and 2. The scraper blade 1 is the most widely used configuration and it is mounted to make an inclination angle, $\alpha$, of 10° to 35° with a tangent line passing through the contact point as shown in FIG. 1. The wiper blade 2 is mounted to make an inclination angle $\beta$ of 60° to 85° as shown in FIG. 2.

Cleaning blades are mounted with some engagement or interference "d" of its free end with the surface to be cleaned with sufficient force to enable cleaning. The cleaning blade force is usually within a range of 10 to 80 g/cm, wherein "cm" represents length in centimeters in the cross-track direction. In FIGS. 1 and 2, the blades are shown in the undeformed shape.

Polyurethane has been the preferred material used for blade cleaning due to its toughness, resiliency and wear resistant properties. This blade material requires a small amount of solid (dry) lubrication on its edge, which contacts the surface to be cleaned, to reduce drag and prevent bonding of the interacting surfaces. Zinc stearate, Teflon™, Kynar™ and other dry lubricants have been used in blade cleaning in prior art. Untransferred toner "fines"; i.e., fine particles, provide lubrication to the blade during normal printing operations.

The cleaning method which is most used in current practice for the detone roller is that of a scraper blade made out of steel or phosphorus bronze as shown in one of the brush cleaner configurations in FIG. 3.

In the above applications, dusting inside the cleaner is particularly high during cleaning cycles where high levels of toner mass laydown are on the surfaces to be cleaned. Dusting emanates from the interface between the surface contaminated with charged toner particles and the blade edge. Containment of air borne toner particles is highly desirable in order to minimize the likelihood of leaks that will generate machine contamination. To prevent dusting from leaking out of the blade cleaner housing, the cleaner requires good overall sealing. Foam or brush seals, 3, at the front and back ends of the blade and an upstream sealing blade, 4, are among the methods used to prevent dust from leaking out. These sealing components are shown in FIGS. 1 and 2.

When the scraper blade is made out of steel, it usually has residual magnetism. This residual magnetism on the blade material causes magnetized carrier particles to be attracted to the blade edge. Magnetized carrier particles will be attracted to a ferromagnetic blade, even if it has no residual magnetism. A metallic blade will also form an extremely small nip which may result in higher wear and heat, especially when magnetized particles are trapped at its edge, with the consequent degradation in cleaning performance. The above method, using a magnetic stainless steel blade, when loaded with magnetic carrier particles will become ineffective as a cleaner quite rapidly.

Metallic blades have also been shown to reduce the drag on the surface to be cleaned thus requiring less lubrication than the polyurethane blades.

Metallic blades have shown comparable or higher expected life than polyurethane blades in the absence of carrier particles, but they have not been used to clean photosensitive or scratch-sensitive surfaces due to higher wear on these surfaces. Furthermore, when metallic blades are used, the surfaces to be cleaned require special surface treatments (Martin hard coats, chromium plating) to increase their wear resistance. These special surface treatments increase the cost of the parts. Polyurethane blades do not require such special surface treatments.

Carrier particles can also affect the performance of polyurethane blades if trapped in front of the cleaning edge due to excessive wear of the cleaning surface. In general, polyurethane blades have shown longer lives than steel blades in the presence of carrier particles.

Other types of contamination that can quickly degrade the cleaning blade performance, irrespective of the blade material, are paper dust and paper fibers and lint. As these contaminants are fed to the blade edge, they will build up under the edge and will weaken the sealing contact that the blade edge makes with the surface to be cleaned. The end result is cleaning failure in the form of toner bands or streaks.

SUMMARY OF THE INVENTION

It is an object of the invention to reduce or eliminate the dusting generated by the cleaning blade and the adverse effects of paper dust, paper fibers, other types of elongated fibers and lint. The invention provides a dust seal blade which will create a cavity in front of the cleaning blade allowing the toner dust to be restricted to a very small volume. The air borne toner dust will quickly precipitate forming an accumulation of toner in front of the cleaning blade. This accumulation of toner at the blade edge will prevent incoming toner, which is more tightly attracted to the surface to be cleaned, from becoming air borne, thus eliminating toner dusting from expanding inside the cleaning housing and leaking out from any location lacking proper sealing. The accumulated toner filling the cavity between the dust seal blade and the cleaning blade provides a barrier to prevent paper dust, lint and fibers and magnetized carrier particles from reaching the cleaning blade edge, thus extending the good cleaning performance of the cleaner. The toner fines, which are more tightly held by the surfaces to be cleaned, will be allowed to reach the blade edge providing continuous lubrication to the cleaner. The accumulated toner in the cavity between the cleaning blade and the dust seal blade in close proximity to the surface to be cleaned may also help extract other contaminants such as fuser oil transferred to the surface by a duplex mode of operation. In the duplex mode, in certain printer configurations, prints will have toner images on both sides and the paper will pass by the fuser twice collecting some residual fuser oil that can be transferred back to the surfaces that require cleaning such as drums, webs, and others.

These and other aspects of the invention will become apparent from the following detailed description of several preferred embodiments of the invention.

BRIEF DESCRIPTION OF THE DRAWINGS

In the detailed description of the preferred embodiments of the invention, reference is made to the accompanying drawings in which.

DETAILED DESCRIPTION OF THE PREFERRED EMBODIMENTS

The preferred embodiments are described herein with reference to an electrophotographic copier or printer but it will be understood that the invention can be used in any form of black and white or color electrostatographic copier or printer including electrographic copiers or printers. The description will be directed with the method in accordance with the present invention. It is to be understood that elements not specifically shown or described may take various forms well known to those skilled in the art.

Figure 1:
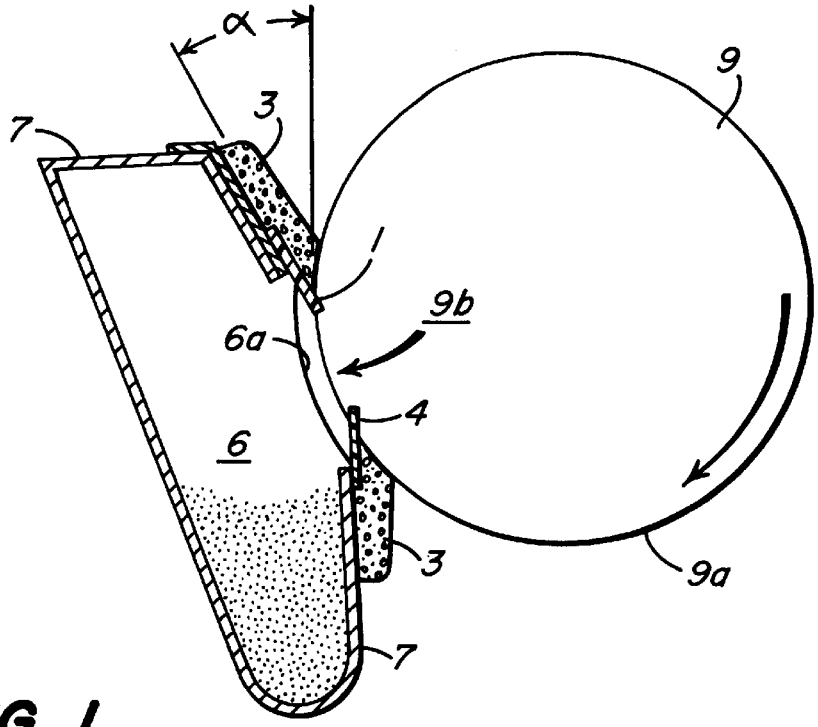
FIG. 1 (PRIOR ART)
FIG. 1 is a side elevational view in schematic form of a scraper blade cleaning apparatus as known in the prior art.

In the prior art cleaning apparatus of FIG. 1 a rotating drum 9 or roller or a moving web that includes remnant toner and/or other particles on a surface 9*a* is cleaned by a scraper blade 1 that is engaged at an angle $\alpha$ of 10° to 35° with the tangent line passing through the contact point of the blade with the surface 9*a* of the drum or roller or web being cleaned. Upstream of the cleaning blade 1, another seal protection is provided by a flexible wiper sealing blade 4 that also contacts the drum surface 9*a* to prevent leaks from the bottom of the cleaner housing 7. Along the cleaner housing 7 and at both the front and back ends of the cleaning blade 1 and the sealing blade 4, there are provided foam or brush seals 3 that engage the drum surface 9*a* to prevent side leaks from both ends of these blades. Between the engagement points by the foam seal 3 and cleaning blade 1, respectively, there is an area 9*b* of the drum surface 9*a* which faces an opening 6*a* in a chamber 6 which chamber is defined by enclosure walls 7. The toner or other remnant particles that are scraped by the cleaning blade 1 from the surface 9*a* are collected in the chamber 6 and may be conveyed by vacuum or mechanical conveyors, to a disposal unit or for recycling. Alternatively, the toner may be allowed to collect in the chamber and be emptied periodically. Generally, a condition of high dusting exists in the chamber and this dust is for the most part blocked from contaminating the other parts of the electrostatographic apparatus by the sealing action provided by the cleaning blade 1, the foam seal 3 and the wall 7 of the chamber. As may be seen both the cleaning blade 1 and the sealing blade 4 are cantileveredly supported on the walls 7.

Figure 2:
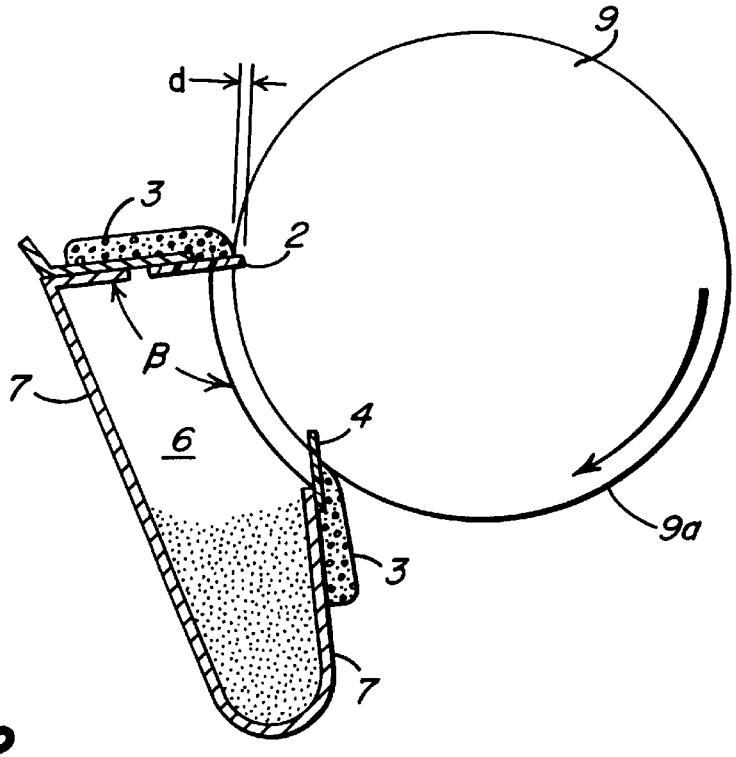
FIG. 2 (PRIOR ART)
FIG. 2 is a side elevational view in schematic form of a wiper blade cleaning apparatus as known in the prior art.

In the prior art cleaning apparatus of FIG. 2 the apparatus is generally similar to that described for FIG. 1 and similar reference numbers are used to refer to similar structures. In this apparatus, a wiper blade 2 is provided that engages the drum surface 9*a* at an angle $\beta$ with the tangent line passing through the contact point of the blade.

Typically, the drum 9, roller or web is a photoconductive member or other primary image forming member (PIFM) or an intermediate transfer member (ITM) which receives a toner image from a PIFM and transfers it to a receiver member to which the toner image is fixed. Untransferred remnant toner remaining on the surface 9*a* is then cleaned by the cleaning apparatus described. As is well known a PIFM forms a toner image from toner particles that are typically less than 20 $\mu$m in mean volume weighted particle diameter size. The toner particles described herein are preferably dry toner particles of a size of about 3 $\mu$m to about 9$\mu$in size and images are developed using a two (or more) component developer that may include magnetic carrier particles. The carrier particles are preferably from about 25 $\mu$m to about 150 $\mu$m in size. Alternatively, a single component developer may be used to develop the image on the PIFM. A toner image on a PIFM is transferred either directly to a receiver member or indirectly first to an ITM from which it is transferred to the receiver member. Toner and other particles that are not transferred to the receiver member need to be removed from the PIFM or ITM to provide for high quality images as the PIFM and ITM are reused.

Figure 3:
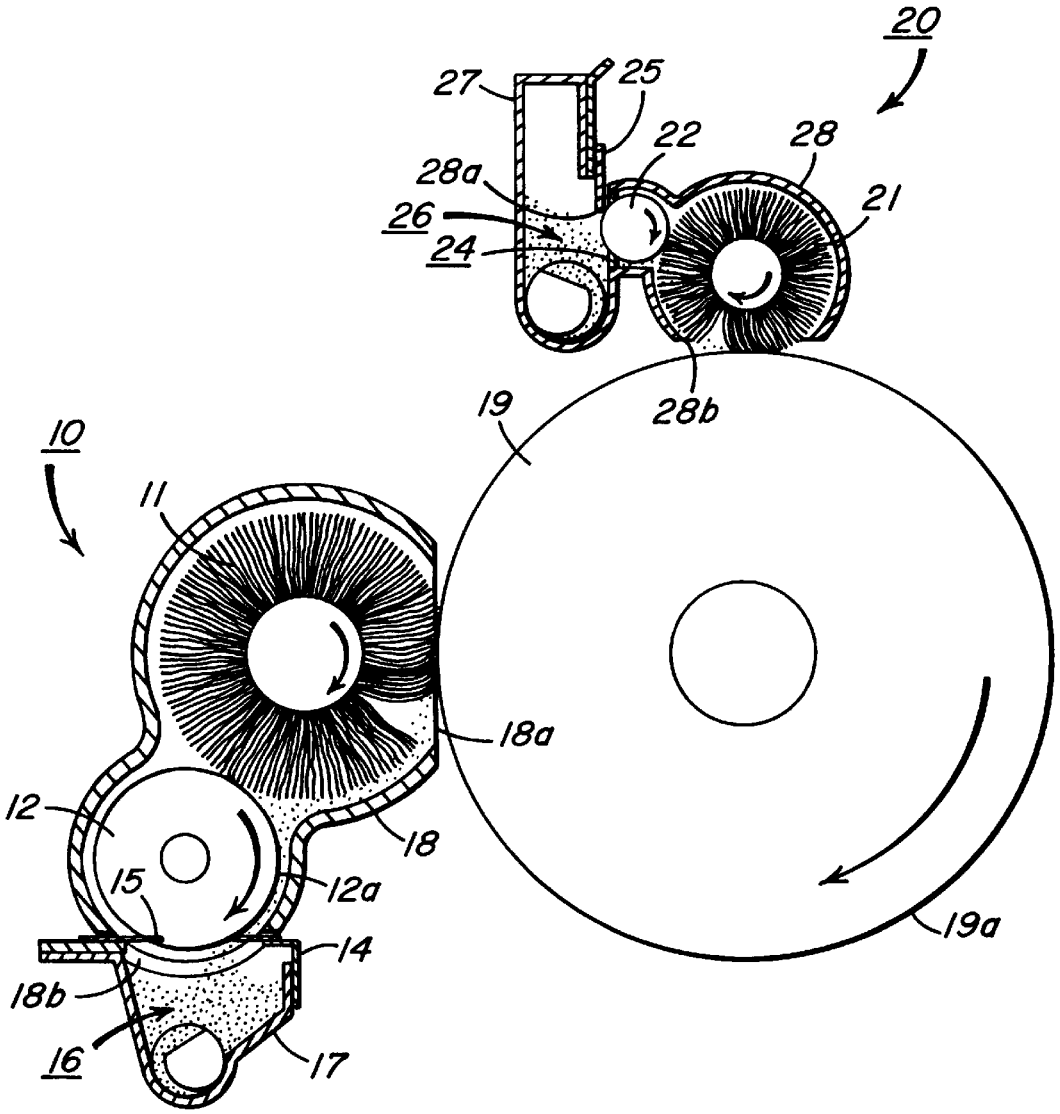
FIG. 3 (PRIOR ART)
FIG. 3 is a side elevational view in schematic form of two cleaning apparatus as known in the prior art wherein each apparatus includes a scraper blade cleaner for cleaning a detone roller that forms part of each cleaning apparatus.

In the embodiment of FIG. 3, there is shown a blade cleaner that forms part of a prior art cleaning apparatus 10. The apparatus 10 is a brush cleaning apparatus that includes a brush 11 that may be a magnetic brush, a conductive fur brush or a nonconductive fur brush. An example of a preferred conductive fur brush cleaning apparatus is described in U.S. application Ser. No. 09/053,504, now U.S. Pat. No. 5,905,932, filed in the names of Theodore Morse et al. now U.S. Pat. No. 5,905,932. The brush 11 rotates in engagement with the surface 19*a* of a drum 19, roller or web which may be either a PIFM, ITM or other moving member in an electrostatographic apparatus that requires cleaning, such as transfer rollers or webs. Toner or other particles are removed from the surface 19*a* and collected on the brush 11. A detone roller 12 rotates in contact with the brush 11. The detone roller's surface 12*a* is generally smooth but electrically biased to electrostatically attract toner and other particles to its surface 12*a*. The detone roller's surface 12*a* is rotated and is engaged by a scraper cleaning blade 15. A sealing blade 14 engages surface 12*a* upstream of the direction of rotation of the detone roller. The scraper blade 15, sealing blade 14 and walls 17 define a chamber 16 within which toner dust is substantially restricted to and substantially prevented from contaminating other parts of the electrostatographic apparatus. A housing wall 18 surrounds most of the cleaning brush 11 and detone roller 12 to confine movement of toner to substantially reduce contamination. Openings 18*a*, 18*b* in the housing wall 18 are provided to allow the cleaning brush 11 to engages the surface 19*a* and to allow the detone roller 12 to be engaged by the cleaning blade 15.

With reference again to FIG. 3, there is shown a second cleaning apparatus 20. Although typically the second cleaning apparatus would not be used to clean the same surface 19*a*, it is shown for illustrative purposes only and may be considered to be cleaning a surface of a different member or be in a different electrostatographic apparatus. The cleaning apparatus 20 includes a cleaning brush 21 which as noted above may be a rotating magnetic brush, a conductive fiber brush or a non-conductive fiber brush. A rotating detone roller 22 engages the cleaning brush 21 and is electrically biased to electrostatically attract toner that was removed by the cleaning brush 21 from the surface 19*a*. The directions of rotation of the brush 21 and detone roller 22 are shown as a counter rotation at the point of engagement but they may also be rotated so that they are not counter rotated at the point of contact. Apparatus 20 also features a scraper blade 25 which engages with and scrapes toner particles from the detone roller 22. Differences between the two embodiments are the orientation of the blade which in one case is horizontal and in the other case is vertical and the blade material being a metallic blade 15 and a polyurethane blade 25. The cleaning blades may be attached to the respective toner collection housing or other suitable structure by suitable well known means such as clips, screws, bolts , rivets, or adhesive. A toner collection housing wall 27, the cleaning blade 25, and the sealing blade 24 define a chamber 26 wherein toner removed from the detone roller is substantially constrained from contaminating other parts of the electrostatographic apparatus.

A housing wall 28 surrounds most of the cleaning brush 21 and detone roller 22 to confine movement of toner to substantially reduce contamination. Openings 28*a*, 28*b* in the housing wall 28 are provided to allow the cleaning brush 21 to engage the surface 19*a* and to allow the detone roller 22 to be engaged by the cleaning blade 25.

Figure 4A:
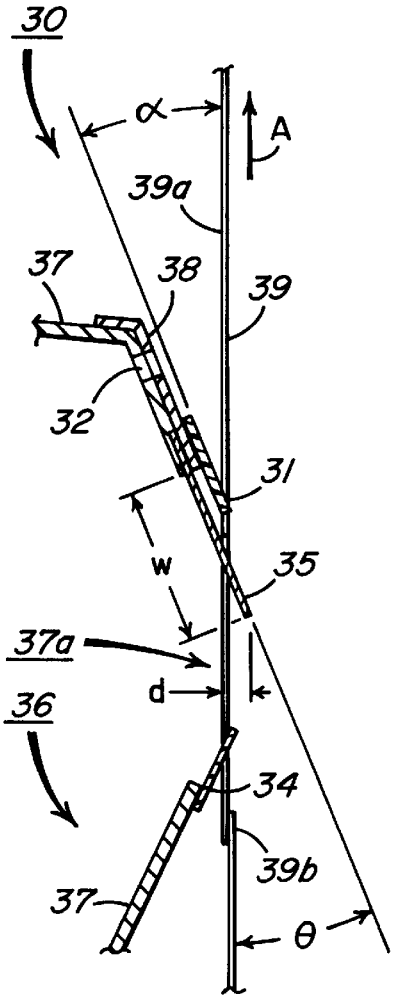
FIGS. 4*a, b* and *c* illustrate in schematic form a portion of a scraper blade cleaning apparatus according to the invention and showing various stages of operation.

Description will now be provided of an improved scraper cleaning blade apparatus 30 made in accordance with a first embodiment of the invention. With reference now to FIGS. 4*a, b* and *c* there is shown a web 39 that is moving vertically in the direction of arrow A. The web may be a photoconductor or other PIFM, an ITM or a paper transport web such as described in international patent publication WO 98/04961. The web 39 has a surface 39*a* and may include a splice 39*b*. In lieu of a web, the surface 39*a* being cleaned may be a drum or roller or a transfer roller or fuser roller or fuser web. The cleaning blade 31 is illustrated as a scraper blade and has one end preferably affixed to a stiffener plate or scraper blade plate 38 and may be mounted to the toner collection chamber housing wall 37 by suitable fasteners passing through aperture 32. The wall 37 defines a toner collection chamber 36 only a portion of the wall 37 being illustrated in FIG. 4*a*. Also, connected to the wall 37 or to the scraper blade plate 38 is a dust seal blade 35, which if the surface being cleaned is removed would extend parallel to the cleaning blade 31. In FIG. 4*a*, the cleaning blade 31 and dust seal blade 35 are shown in their unstressed state as if the surface 39*a* being cleaned was not present. The housing wall 37 generally encloses the cleaning elements as described above for the prior art housing but is provided with an opening 37a between the cleaning blade 31 and the sealing blade 34. The sealing blade 34 is also shown in its unstressed state in FIG. 4*a* and like blades 31 and 35 is cantilevered from the wall 37. In the case of the blade 34 this blade is cantilevered from a bottom segment of wall 37, whereas the upper two blades are cantilevered from an upper segment of wall 37 adjacent opening 37*a*. The dust seal blade 35 has a free extension W, an interference "d" with the surface 39*a* being cleaned in its unstressed state and a dust seal blade angle θ measured by considering the unstressed state of blade 35 and the plane of the surface being cleaned taken at the point where contact with the surface being cleaned would be made. The free end of the dust seal blade 35 extends generally in a direction opposite to that of movement of the surface being cleaned at the location where the dust seal blade engages the surface being cleaned.

Figure 4B:
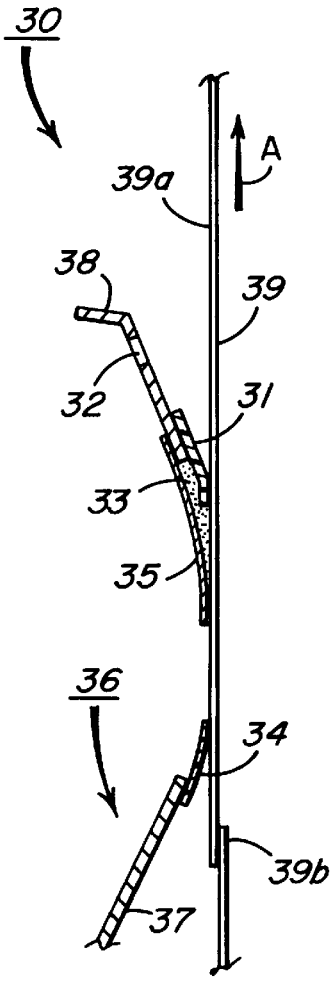
Figure 4C:
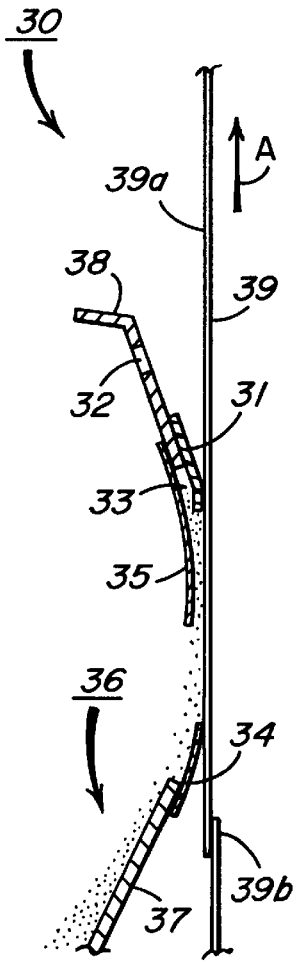

In operation of the cleaning apparatus 30 as illustrated in FIGS. 4*b* and 4*c*, wherein the wall 37 is not shown but is otherwise present, both the scraper cleaning blade 31 and the dust seal blade 35 deflect against the surface 39*a*. Toner particles and other particles on the surface 39*a* are scraped by the cleaning blade 31 from the surface and initially start to collect in a minor collection chamber or cavity 33 that is formed between the dust seal blade 35, the surface 39*a* being cleaned and the scraper blade 31. As shown in FIG. 4*c*, eventually the minor collection chamber 43 fills and causes the dust seal blade 35 to be removed from engagement with the surface 39*a* being cleaned. This allows toner and other contaminants such as lint, paper or other fibers, carrier or paper dust to fall under the action of gravity into the collection chamber 36 such as by sliding by gravity along the bottom sealing blade 34. Clumps of toner particles formed in the cavity also fall into the chamber 36.

Figure 5A:
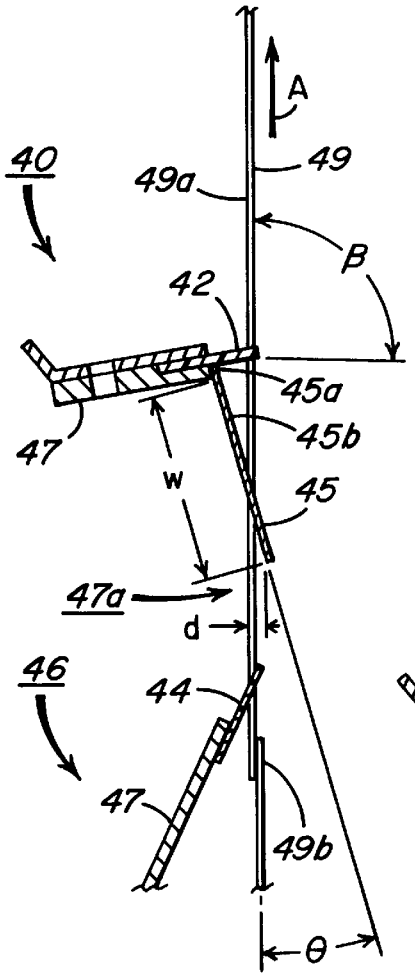
FIGS. 5*a, b* and *c* illustrate in schematic form a portion of a wiper blade cleaning apparatus according to the invention and showing various stages of operation.

Description will now be provided of an improved wiper cleaning blade apparatus 40 made in accordance with another embodiment of the invention. With reference now to FIGS. 5*a, b* and *c* there is shown a web 49 that is moving vertically in the direction of arrow A. The web may be a photoconductor or other PIFM, an ITM or a paper transport web such as described in international patent publication WO 98/04961. The web 49 has a surface 49*a* and may include a splice 49*b*. In lieu of a web, the surface 49*a* being cleaned may be a drum or roller or a transfer roller or fuser roller or fuser web. The cleaning blade 42 is illustrated as a wiper blade and may be mounted to the toner collection chamber housing wall 47 that defines a toner collection chamber 46 only a portion of the wall 47 being illustrated in FIGS. 5*a, b* and *c*. Also, connected to the wall 47 is a dust seal blade 45.

The dust seal blade may include a segment 45*a* that is connected to the wiper blade supported end and is bent to have a free segment 45*b* that extends as shown. In FIG. 5A, the cleaning blade 42 and dust seal blade 45 are shown in their unstressed state as if the surface 49*a* being cleaned was not present. The housing wall 47 generally encloses the cleaning elements but is provided with an opening 47*a* between the cleaning blade 42 and the sealing blade 44, the latter of which is also shown in its unstressed state in FIG. 5*a* and is like blades 42 and 45 cantilevered from the wall 47. In the case of the sealing blade 44 this blade is cantilevered from a bottom segment of wall 47, whereas the upper two blades are cantilevered from an upper segment of wall 47 adjacent opening 47*a*. The dust seal blade 45 has a free extension W, an interference "d" with the surface 49*a* being cleaned in its unstressed state and a dust seal blade angle θ measured by considering the unstressed state of blade 45 and the plane of the surface being cleaned taken at the point where contact with the surface being cleaned would be made. The free end of the dust seal blade 45 extends generally in a direction opposite to that of movement of the surface being cleaned at the location where the dust seal blade engages the surface being cleaned.

Figure 5B:
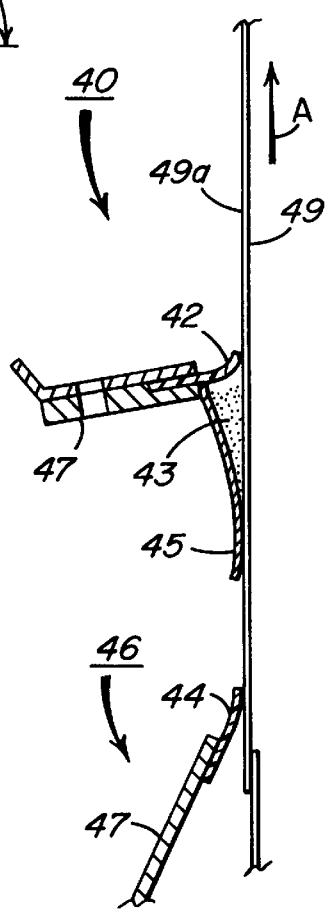
Figure 5C:
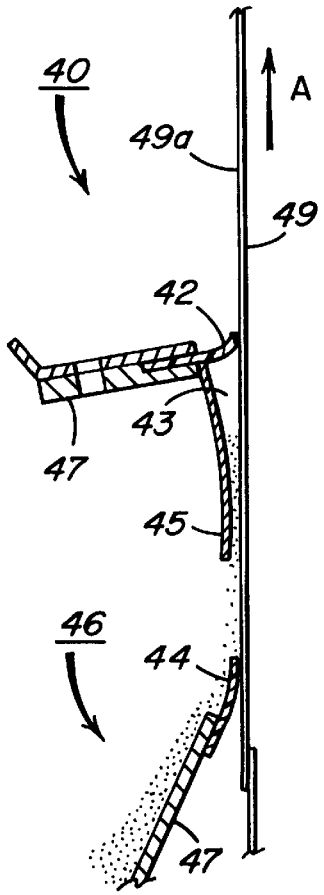

In operation of the cleaning apparatus 40 as illustrated in FIGS. 5*b* and 5*c*, both the wiper cleaning blade 42 and the dust seal blade 45 deflect against the surface 49*a*. Toner particles and other particles on the surface 49*a* are wiped by the cleaning blade 42 from the surface 49*a* and initially start to collect in a minor collection chamber or cavity 43 that is formed between the dust seal blade 45, the surface 49*a* being cleaned and the wiper blade 42. As shown in FIG. 5*c*, eventually the minor collection chamber 43 fills and causes the dust seal blade 45 to be removed from engagement with the surface 49*a* being cleaned. This allows toner clumps and other contaminants such as lint, paper or other fibers, carrier or paper dust to fall under the action of gravity into the collection chamber 46 such as by sliding along the bottom sealing blade 44.

The above described concept of creation of a minor collection chamber or cavity at the working blade has been shown to work with either scraper or wiper cleaning blades and with either polyurethanes or steel blades.

The dust seal blade 35, 45 should be mounted as a scraper blade with an inclination angle θ between a tangent to the surface to be cleaned at contact and its surface facing the inside of the cavity of 10° to 30°, preferably 15° to 25° (FIGS. 4 and 5). The preferred configuration is that which allows toner in the cavity to fall down into a sump by gravity. Other configurations may work to constrain the dust but are less effective to prevent carrier and fibers from reaching the blade edge.

The dust seal blade 35, 45 is designed to apply to the surface to be cleaned a very low load, usually much less than 10 g/cm, by selecting the material, free extension and thickness so as to work as a very weak spring. It is also highly desirable to deflect the dust seal blade enough to cause the free end to turn away from the cleaning surface. This is particularly important in dealing with transport webs or photoconductor webs having a splice that could cause the dust seal to invert.

The dust seal blade material may be selected from a wide range of plastics such as PET (polyethelene terephtalate), MYLAR™, polyester, polycarbonate, Teflon™, polyurethanes with low surface adhesion, etc. It is preferred that the dust seal blade material have wear resistance, low tribocharging and low friction with the surface to be cleaned to further reduce chances for the seal to become inverted or tucked under.

The thickness of the dust seal blade, t, and its free extension, W, are selected to make the seal a much weaker spring than the cleaning blade. For blades of PET and MYLAR™, a dust seal blade thickness range of 0.001" and 0.003" is suitable with the free extension W being within the range of 0.200" to 1.000". The dust seal blade thickness should be less than 0.005" and its free extension should be higher than 0.200". Another way to select the dust seal blade stiffness is by specifying the ratio of dust seal thickness over its free extension, t/W, which should be less than 0.015.

The recommended range of engagement or interference "d" between the dust seal blade 35, 45 and the surface to be cleaned is less than 0.100". Other values of engagements may be fine as long as the blade load is much less than 10 g/cm and its free end is curled away from the surface to be cleaned.

The dust seal blade length, L, taken in the cross-track direction that is perpendicular to the direction of movement of the surface being cleaned should be equal to or shorter than the length of the cleaning blade. By using a shorter length for the dust seal, toner in the cavity or minor collection chamber will have less probability of leaking at the interface between the ends of the cleaning blade and the ends of the foam seals. The cleaning blade length is preferably slightly shorter than the cross-track length of the surface being cleaned. The foam seal surrounds the opening between the collection chamber housing and the surface being cleaned and thus seals the ends or sides of the cleaning blade and the bottom seal blade. Preferably, the foam seal is also inboard of the edges of the surface being cleaned to reduce damage to the foam seal.

The dust seal blade 35, 45 is preferably mounted under tension to a flat and rigid plate to insure its straightness and to prevent waviness formation at its free end due to high relative humidity and temperature. If waves are allowed to form at the free end of the dust seal blade, dusting may leak out of the cavity.

Figure 6:
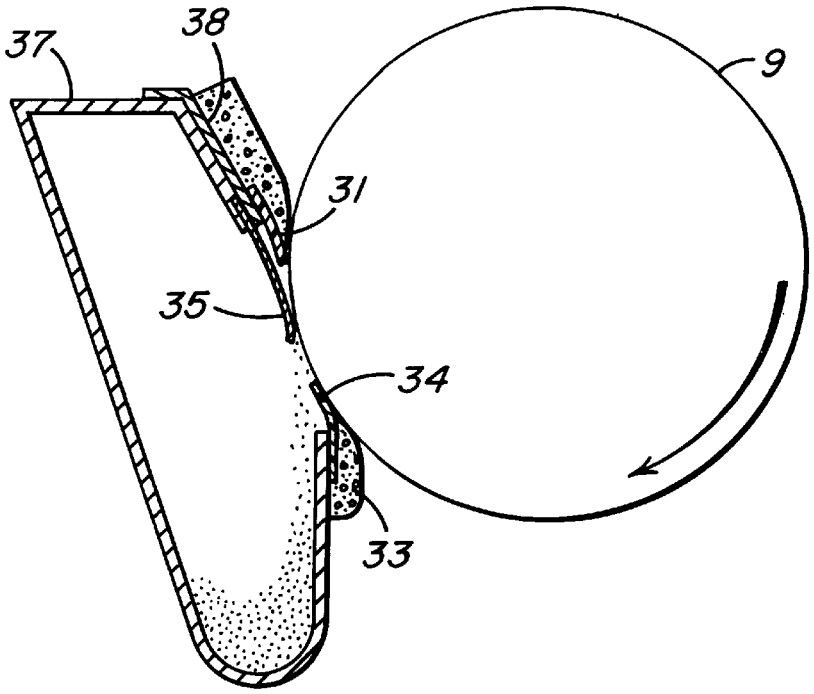
FIG. 6 is a side elevational view in schematic form of a cleaning apparatus according to the invention and featuring the portion illustrated in FIGS. 4*a, b* and *c;*
Figure 7:
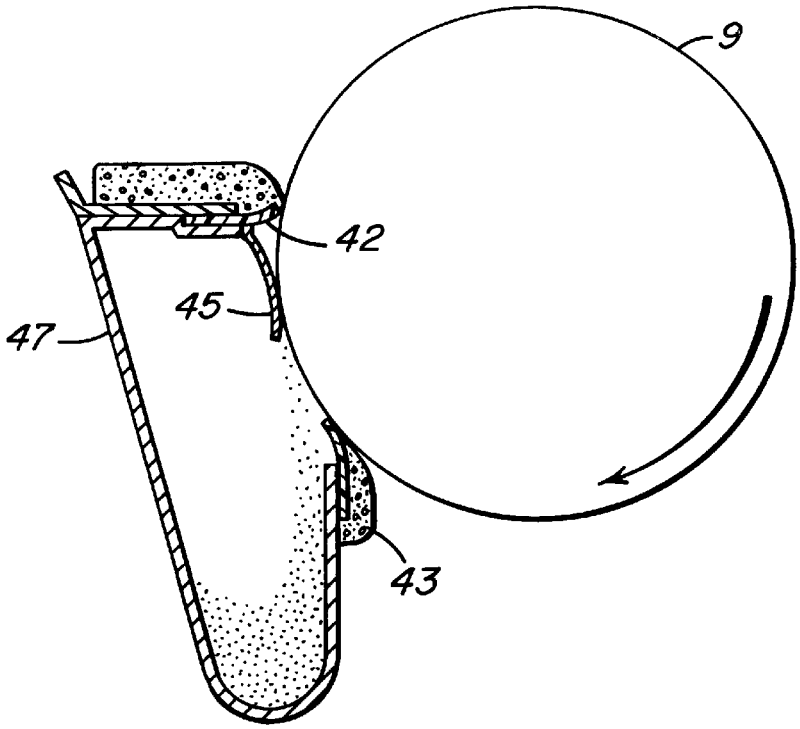
FIG. 7 is a side elevational view in schematic form of a cleaning apparatus according to the invention and featuring the portion illustrated in FIGS. 5*a, b* and *c;*

As toner particles build up in the cavity, the trapped material will apply pressure on the dust seal blade which is a weak spring. As the toner pressure builds up in the cavity, it will lift the free end of the seal away from the surface being cleaned which then allows toner to drop in clumps, taking with it fibers and carrier particles trapped at the entrance to the cavity (FIGS. 6 and 7). Toner trapped in the cavity that is closest to the surface to be cleaned may also help extract oil residues placed on the surface by papers when the printer is operating during a duplex operation.

The above dust seal blade concept is suited for blade cleaning of a drum, roller or a web and it may significantly reduce dusting generated at the cleaning blade edge.

When the cavity between the dust seal and the cleaning blade is full, contaminants drop down into the sump in clumps rather than dusting. The filled cavity presents a barrier for incoming fibers, paper dust, lint and carrier particles, restricting their entrance and eventual trapping at the blade edge. The trapped toner fines also provide continuous supply of lubrication for the blade that might reduce conditions such as cleaning blade inversion, high drag and premature wear of the surface to be cleaned.

It is preferred to clean a detone roller surface using a compliant polyurethane scraper blade. The polyurethane blade may form a wider nip with the roller that can result in lower pressure. Polyurethane is a wear resistant and tough material that will perform effective removal or prevention of scum over longer time, since carrier is not magnetically attracted to its edge and its cleaning edge should provide enough abrasion to maintain the roller surface clean. Other nonmagnetic blade materials may also be suitable for preventing the attraction of magnetized particles to the cleaning blade edge.

Thus, advantages of the dust seal blade are to reduce or to eliminate dusting emanating from the cleaning blade edge interface, to prevent paper dust, fibers, lint and magnetized carrier particles from reaching the cleaning blade edge and to provide a source of continuous lubrication to the blade by the toner particles trapped in the cavity and by helping extract oil residues from the surface to be cleaned. The dust seal blade has a wide range of applications and is not limited to the field of electrophotography or electrography. It can be used in blade cleaners, magnetic brush and conductive brush detone rollers, spot blades, transport web cleaners, intermediate transfer and direct transfer cleaners, transfer roller or web cleaners. The dust seal blade can be used with either a scraper or a wiper cleaning blade configuration. Foam or brush seals 33 (FIG. 6); 43 (FIG. 7) are preferably provided at the front and back ends of both the cleaning blade and the upstream sealing blade locations to prevent side leaks.

Figure 8:
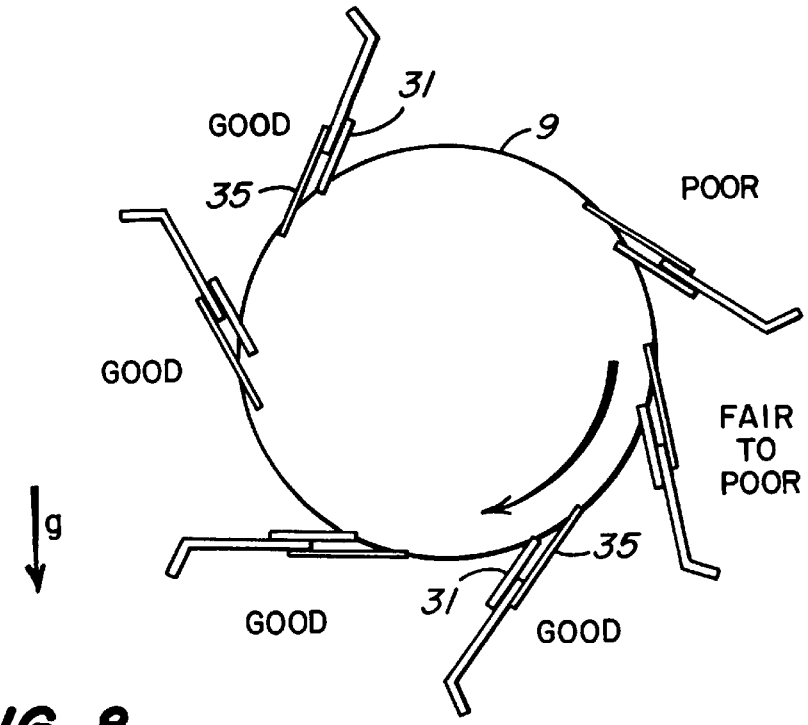
FIGS. 8 and 9 illustrate in schematic form various possible operational positions of a scraper blade and wiper blade, respectively, in accordance with the invention.

With reference to FIG. 8, there are illustrated various possible exemplary orientations of the scraper blade 31 and dust seal blade 35 relative to the direction of gravity (arrow g). Certain orientations as indicated are preferred (good) over other orientations (poor or fair to poor). These locations are based on how gravity affects the collection of toner, fibers, carrier and other contaminants. In the case of the orientations indicated to be poor or fair to poor, it may be seen that the cavity formed by the scraper blade and dust seal blade tends to have contaminants collecting and in some respect, blocking the flow of contaminants down to a collection chamber.

Figure 9:
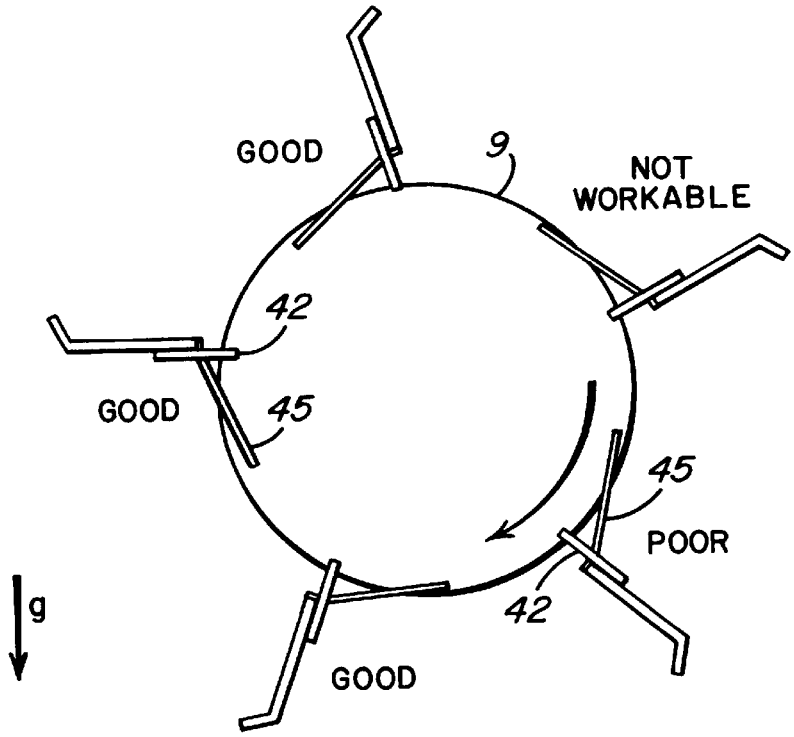

With reference to FIG. 9, there are illustrated various possible exemplary orientations of the wiper blade 42 and dust seal blade 45 relative to the direction of gravity (arrow g). Certain orientations as indicated are preferred (good) over other orientations (poor or not workable). These locations are based on how gravity affects the collection of toner, fibers, carrier and other contaminants. In the case of the orientations indicated to be poor or not workable, it may be seen that the cavity formed by the wiper blade and dust seal blade tends to have contaminants collecting and in some respect, blocking the flow of contaminants down to a collection chamber.

Figure 10:
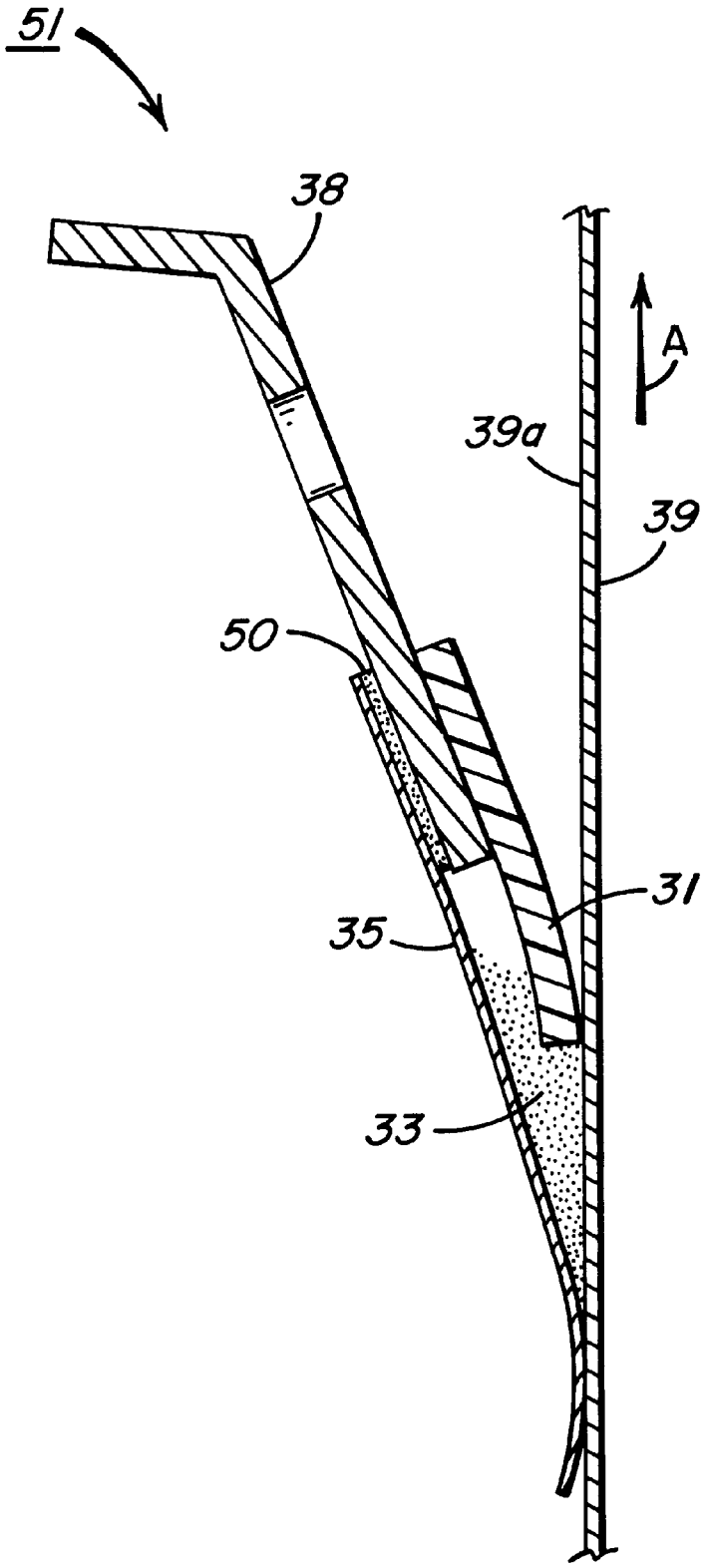
FIGS. 10, 11 and 12 are enlarged side elevational views of possible mounting techniques to install dust seal blades in either scraper or wiper blade cleaners.
Figure 11:
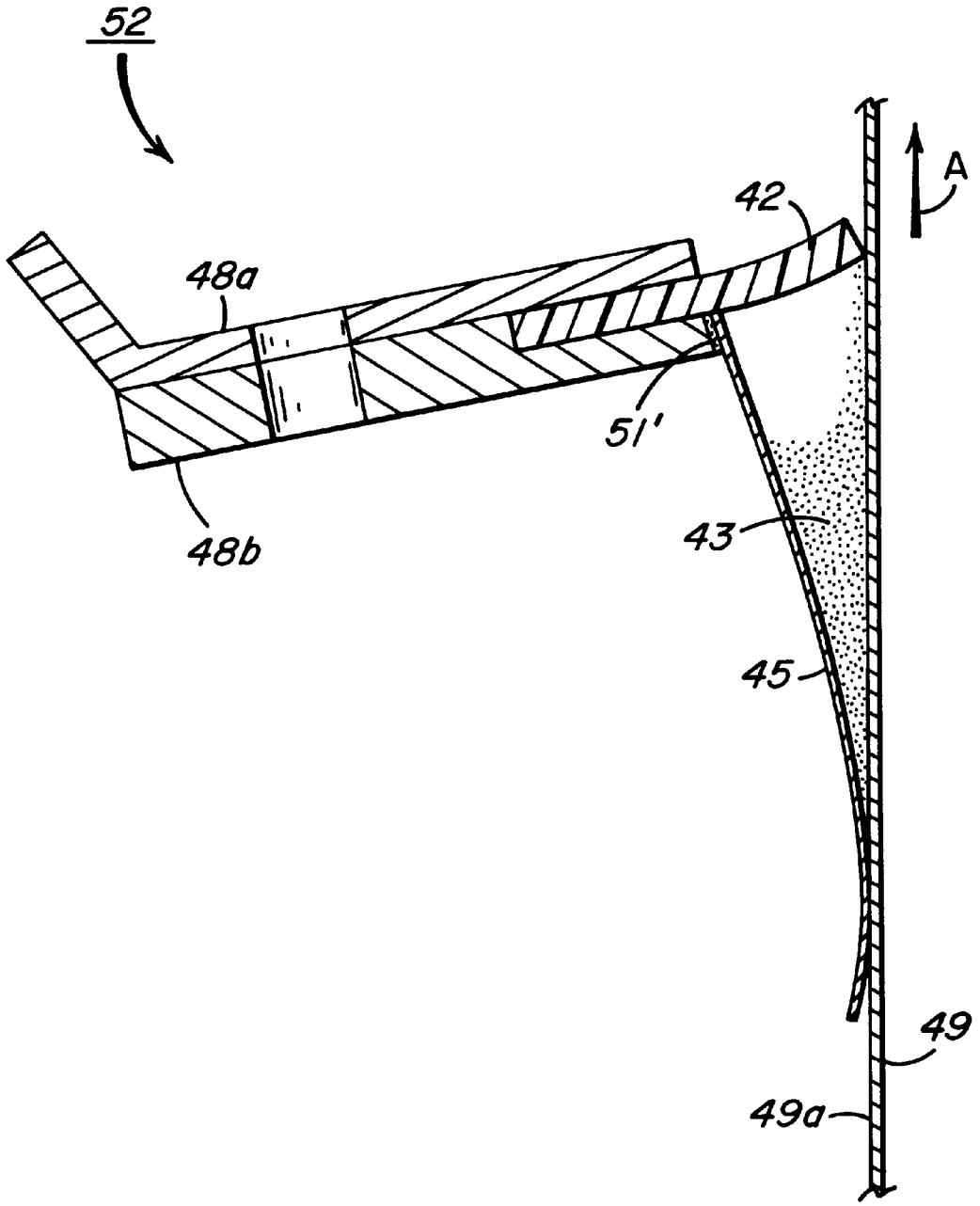
Figure 12:
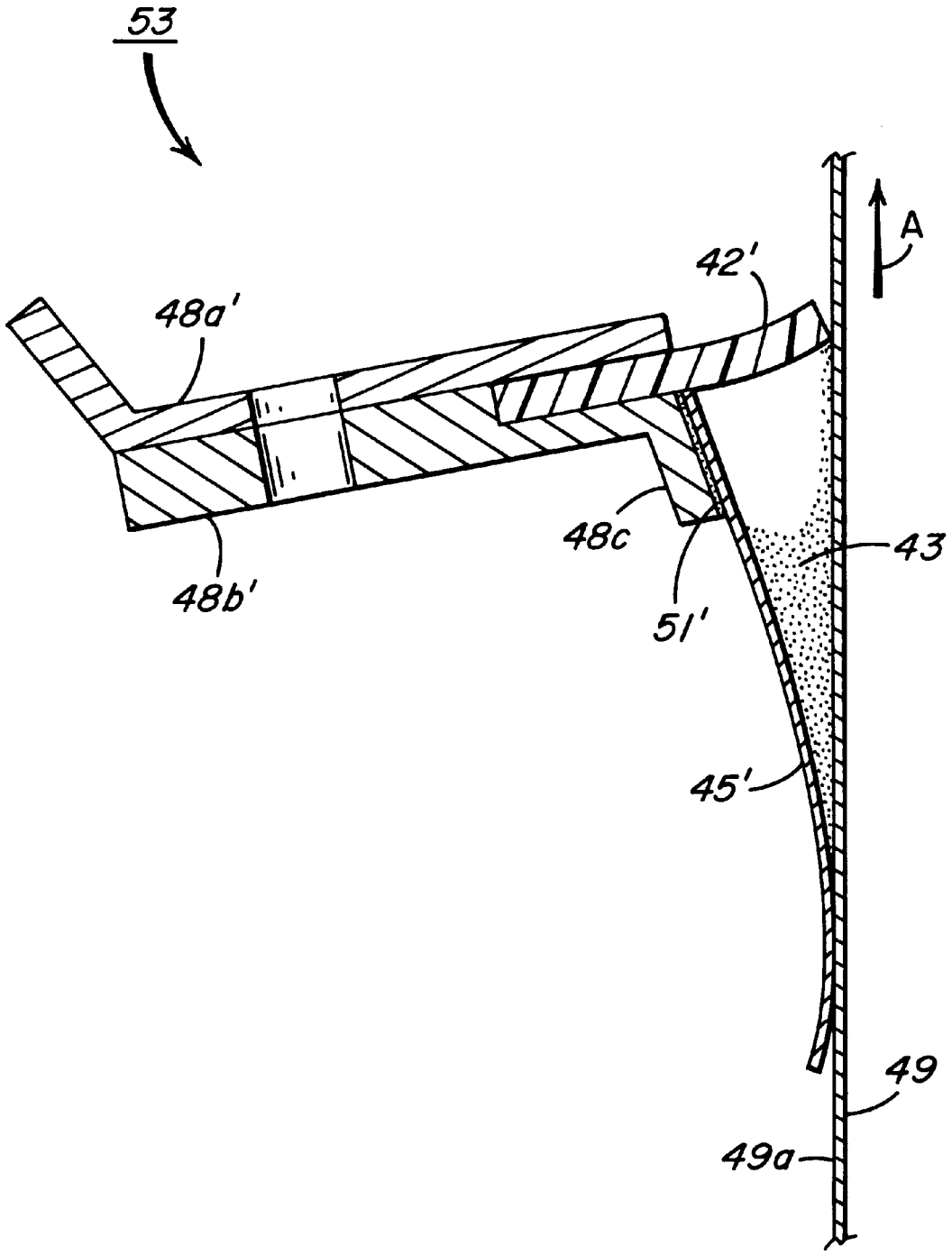

With reference to FIGS. 10–12, there are shown respective enlarged views of cleaning blade assemblies 51, 52, and 53 that form a part of the cleaning blade apparatus of the invention. The assemblies each have the scraper blade or wiper blade and dust seal blade mounted to the stiffener plate. The assembly can be a replaceable part that is attached to a wall of the toner collection chamber as noted previously.

With reference to FIG. 10, the cleaning blade assembly 51 comprises the stiffening plate 38, the scraper blade 31 and the dust seal blade 35 of FIG. 4*a*. The dust seal blade is shown having one end attached to the stiffener plate 38 using double sided adhesive tape 50 that attaches one surface of the stiffener plate to the dust seal blade. The opposite or second surface of the stiffener plate 38 has the scraper blade attached thereto using adhesive or bolts. The assembly may be bolted or otherwise suitably attached to the container housing wall.

With reference to FIG. 11, the cleaning blade assembly 51 comprises a two piece stiffening plate that includes an upper plate 48*a* and a lower plate 48*b*. The wiper blade 42 is sandwiched in a recess between the upper and lower plates. Alternatively, no recess may be provided. The dust seal blade 45 is shown having one end attached to an edge of lower plate 48*b* with double sided adhesive tape. Instead of the use of two plates, the stiffening plate may be only one plate with the wiper blade attached to one surface and the dust seal blade attached to an edge or the other surface of the stiffening plate such as if upper plate 48*a* is eliminated. As another alternative, the dust seal blade 45 may have one end located beneath the wiper blade so that both are attached to the same surface of the stiffener plate so that the dust seal blade is attached to the stiffener plate directly and the wiper blade overlies the dust seal blade. In the latter example, the dust seal blade may have a fold to bend it around the edge of the stiffener plate.

In a further alternative embodiment of a cleaning blade assembly, the assembly 53 of FIG. 12 illustrates an assembly similar to that of FIG. 11 except that the lower stiffening plate 48*b*' has a descending leg 48*c*' to which the dust seal blade 45' is attached using double sided adhesive tape 51'. The wiper blade 42' as noted above may be either located between the two upper and lower plates 48*a*', 48*b*' or the stiffener plate may comprise only one plate. The above attaching means are exemplary and other attaching elements may be used as noted above.

In the embodiments described above, scraper blades are generally preferred except for conditions where instability of the cleaning blade might dictate the use of a wiper blade such as when the blade might not be exposed to toner over long runs.

The invention has been described in detail with particular reference to presently preferred embodiments, but it will be understood that variations and modifications can be effected within the spirit and scope of the invention.

We claim:

1. A cleaning apparatus for removing toner and/or other contaminant particles from a surface to be cleaned in an electrostatographic apparatus, the surface moving in a first direction, the cleaning apparatus comprising:

a cleaning blade having a free extension portion engaging the surface to be cleaned at a first location wherein the cleaning blade is a scraper blade;

a dust seal blade extending toward the surface to be cleaned in a second direction generally opposite to the first direction and of a length and supported so the first location, wherein the dust seal blade has a thickness to free extension portion length ratio of less than 0.015; and a collection chamber into which the contaminant particles removed from the surface to be cleaned are collected, wherein the cleaning blade, the dust seal blade and the surface to be cleaned form a cavity for containing contaminant particles to assist in operation of the cleaning apparatus.

2. The cleaning apparatus of claim 1 wherein the dust seal blade is inclined relative to the surface to be cleaned at an angle $\theta$ of between 10° to 30° and wherein $\theta$ is the angle between a tangent to the surface to be cleaned at contact at the second location and a surface of the dust seal blade facing the inside of the cavity.

3. The cleaning apparatus of claim 2 wherein the dust seal blade is less than 0.005 inches in thickness.

4. The cleaning apparatus of claim 1 wherein the cleaning blade is at an angle $\alpha$ of between 10° to 35° with a tangent line passing through the surface to be cleaned at the first location.

5. A cleaning apparatus for removing toner and/or other contaminant particles from a surface to be cleaned in an electrostatographic apparatus, the surface moving in a first direction, the cleaning apparatus comprising:

a cleaning blade engaging the surface to be cleaned at a first location, wherein the cleaning blade is a wiper blade;

a dust seal blade having a free extension portion extending toward the surface to be cleaned in a second direction generally opposite to the first direction and of a length and supported so as to be able to contact the surface to be cleaned at a second location upstream of the first location and the dust seal blade has a thickness to free extension portion length ratio of less than 0.015; and a collection chamber into which the contaminant particles removed from the surface to be cleaned are collected, wherein the cleaning blade, the dust seal blade and the surface to be cleaned form a cavity for containing contaminant particles to assist in operation of the cleaning apparatus.

6. The cleaning apparatus of claim 5 wherein the dust seal blade is inclined relative to the surface to be cleaned at an angle θ of between 10° to 30° and wherein θ is the angle between a tangent to the surface to be cleaned at contact at the second location and a surface of the dust seal blade facing the inside of the cavity.

7. The cleaning apparatus of claim 6 wherein the dust seal blade is less than 0.005 inches in thickness.

8. A method of cleaning toner and/or other contaminant particles from a surface in an electrostatographic apparatus comprising:

moving a surface to be cleaned in a first direction;

engaging the surface to be cleaned at a first location with a cleaning blade to remove the particles from the surface wherein the cleaning blade is a scraper blade;

providing a dust seal blade having a free extension portion extending toward the surface to be cleaned in a second direction generally opposite to the first direction and of a length and supported so as to be able to contact the surface to be cleaned at a second location upstream of the first location and the dust seal blade has a thickness to free extension portion length ratio of less than 0.015;

forming a cavity with the cleaning blade, the dust seal blade and the surface to be cleaned for containing contaminant particles to assist in operation of the cleaning blade apparatus.

9. The method of claim 8 wherein the dust seal blade is inclined relative to the surface to be cleaned at an angle θ of between 10° to 30° and wherein θ is the angle between a tangent to the surface to be cleaned at contact at the second location and a surface of the dust seal blade facing the inside of the cavity.

10. The method of claim 8 wherein the dust seal blade is less than 0.005 inches in thickness.

11. The method of claim 8 wherein the cleaning blade is at an angle α of between 10° to 35° with a tangent line passing through the surface to be cleaned at the first location.

12. A method of claim of cleaning toner and/or other contaminant particles from a surface in an electrostatographic apparatus comprising:

moving a surface to be cleaned in a first direction;

engaging the surface to be cleaned at a first location with a cleaning blade to remove the particles from the surface wherein the cleaning blade is a wiper blade;

providing a dust seal blade having a free extension portion extending toward the surface to be cleaned in a second direction generally opposite to the first direction and of a length and supported so as to be able to contact the surface to be cleaned at a second location upstream of the first location and the dust seal blade has a thickness to free extension portion length ratio of less than 0.015;

forming a cavity with the cleaning blade, the dust seal blade and the surface to be cleaned for containing contaminant particles to assist in operation of the cleaning blade apparatus.

13. The method of claim 12 wherein the dust seal blade is inclined relative to the surface to be cleaned at an angle θ of between 10° to 30° and wherein θ is the angle between a tangent to the surface to be cleaned at contact at the second location and a surface of the dust seal blade facing the inside of the cavity.

14. The method of claim 13 wherein dust seal blade is less than 0.005 inches in thickness.

15. A cleaning blade assembly for use in the method of cleaning toner and/or other contaminant particles from a surface in an electrostatographic apparatus comprising the steps of: moving a surface to be cleaned in a first direction; engaging the surface to be cleaned at a first location with a cleaning blade to remove the particles from the surface; providing a dust seal blade extending toward the surface to be cleaned in a second direction generally opposite to the first direction and of a length and supported so as to be able to contact the surface to be cleaned at a second location upstream of the first location; forming a cavity with the cleaning blade, the dust seal blade and the surface to be cleaned for containing contaminant particles to assist in operation of the cleaning blade apparatus; the assembly comprising:

a stiffening plate;

a dust seal blade having one end attached to the stiffening plate and having a free extension length W of material extending away from the plate, the dust seal blade having a thickness to free extension ratio of less than 0.015; and a cleaning blade having one end attached to the stiffening plate and a working end used for cleaning extending away from the stiffening plate.

* * * * *

UNITED STATES PATENT AND TRADEMARK OFFICE

CERTIFICATE OF CORRECTION

PATENT NO. : 5,991,568
DATED : November 23, 1999
INVENTOR(S) : Francisco L. Ziegelmuller et al.

It is certified that error appears in the above-identified patent and that said Letters Patent is hereby corrected as shown below:

Column 10,
Line 29, after "blade", delete "having a free extension portion";
Line 32, after "blade", insert -- having a free extension portion --;
Line 34, after "so", insert -- as to be able to contact the surface to be cleaned at a second location upstream of --;

Column 11,
Line 36, delete "apparatus";
Line 48, delete "of claim";

Column 12,
Lines 15 and 37, delete "apparatus".

Signed and Sealed this

Sixteenth Day of April, 2002

*Attest:*

*Attesting Officer*

JAMES E. ROGAN
*Director of the United States Patent and Trademark Office*